US012025417B1

(12) United States Patent
Burnsed, Jr. et al.

(10) Patent No.: US 12,025,417 B1
(45) Date of Patent: Jul. 2, 2024

(54) GRENADE POUCH LID

(71) Applicant: Blue Force Gear, Inc., Pooler, GA (US)

(72) Inventors: Ashley A. Burnsed, Jr., Port Wentworth, GA (US); Stephen G. Hilliard, Charleston, SC (US)

(73) Assignee: Blue Force Gear, Inc., Pooler, GA (US)

( * ) Notice: Subject to any disclaimer, the term of this patent is extended or adjusted under 35 U.S.C. 154(b) by 0 days.

(21) Appl. No.: 17/099,957

(22) Filed: Nov. 17, 2020

Related U.S. Application Data

(63) Continuation of application No. 16/662,544, filed on Oct. 24, 2019, now Pat. No. 10,871,362, which is a continuation of application No. 15/390,334, filed on Dec. 23, 2016, now abandoned, which is a continuation of application No. 14/150,379, filed on Jan. 8, 2014, now Pat. No. 9,528,807.

(51) Int. Cl.
*F42B 27/00* (2006.01)
*F42B 39/02* (2006.01)

(52) U.S. Cl.
CPC ..... *F42B 39/02* (2013.01)

(58) Field of Classification Search
CPC .. F42B 27/00; F42B 39/02; A45F 5/00; A45F 5/02; A45F 2200/0591; B65F 1/1615
USPC ..... 224/241–243, 675, 242–243, 245–246; 220/375, 810, 212, 737, 740, 522, 521, 220/903; 215/227; 206/3, 317
See application file for complete search history.

(56) References Cited

U.S. PATENT DOCUMENTS 4,147,285 A * 4/1979 Bobrick ..... A44C 5/246 63/4
4,545,501 A * 10/1985 DeFord ..... B65F 1/1615 220/318
5,038,985 A * 8/1991 Chapin ..... G01B 5/0002 24/3.12
8,011,544 B1 * 9/2011 Howell ..... F42B 39/02 224/675
2007/0039989 A1 * 2/2007 Nistico ..... F41H 9/10 224/674

(Continued)

OTHER PUBLICATIONS

Soldier Systems Daily, "AUSA 19—RE Factor Tactical 40mm Grenade Pouch Update," http://soldiersystems.net/2019/10/15/ausa-19-re-factor-tactical-40mm-grenade-pouch-update/#comments, Published Oct. 15, 2019, Accessed Oct. 20, 2019.

*Primary Examiner* — Adam J Waggenspack
(74) *Attorney, Agent, or Firm* — Merchant & Gould P.C.

(57) ABSTRACT

A grenade pouch lid has a rim engagement feature, and the rim engagement feature is operable to secure the planar body to an object having a disc-shaped rim when the rim engagement feature is urged against the rim. The rim engagement feature may include at least two spaced apart elements defining a space therebetween for receiving the rim. The planar body may include a slot, the slot being operable to receive one end of a strap. The planar body may include a wedge shaped portion, the wedge-shaped portion being opposed to the rim engagement feature. The rim engagement feature and the rim may have the same radius. The planar body may cover the center of the rim when the planar body is secured to the object. The object having a disc-shaped rim may be a 40 mm grenade. A grenade pouch is also disclosed.

1 Claim, 13 Drawing Sheets

(56) References Cited

U.S. PATENT DOCUMENTS

2014/0053385 A1* 2/2014 Nielsen-Cole ..... A45F 5/021
403/326

* cited by examiner

GRENADE POUCH LID

CROSS-REFERENCE TO RELATED APPLICATION

This is a Continuation of U.S. patent application Ser. No. 16/662,544, now issued as U.S. Pat. No. 10,871,362, entitled "GRENADE POUCH LID," filed Oct. 24, 2019, which is a Continuation of U.S. patent application Ser. No. 15/390,334, entitled "GRENADE POUCH LID," filed Dec. 23, 2016, which is a Continuation of U.S. patent application Ser. No. 14/150,379, now issued as U.S. Pat. No. 9,528,807, entitled "GRENADE POUCH LID," filed Nov. 9, 2015, which are hereby incorporated by reference in their entirety for all that is taught and disclosed therein.

FIELD OF THE INVENTION

The present invention relates to grenade pouches, and more particularly to a grenade pouch lid that protects a grenade primer from impact and secures the grenade in a grenade pouch.

BACKGROUND OF THE INVENTION

Grenade pouches are desirable for enabling law enforcement and military personnel to carry grenades on their person. Grenade pouches are frequently designed to attach to tactical vests so the grenade pouches can be worn. Grenade pouches are designed with flaps that secure the grenades within the grenade pouches while still enabling quick access to the grenades contained therein.

Although grenade pouches provide obvious advantages to the wearer, conventional approaches have also suffered from significant disadvantages. Conventional grenade pouches used with 40 mm grenades, which is a military grenade caliber for grenade launchers, are capable of preventing the grenade from falling out of the grenade pouch through use of a removable strap over the base of the grenade. However, the securing strap of a conventional grenade pouch does not meaningfully protect the percussion primer at the base of the grenade from strong impacts, which could cause catastrophic unintentional discharge of the grenade if an object struck the primer with sufficient force.

In addition, existing grenade pouches suffer from other disadvantages. The speed of deployment may be limited when a simple hook and loop fastener strap is used because of the possibility of a misaligned strap making immediate locating and grasping difficult. Such straps also generate noise when opened, and the loose strap dangling after one grenade has been removed may impair access to other grenades or gear, or may tangle with other items.

Therefore, a need exists for a new and improved grenade pouch lid that protects a grenade primer from impact and secures the grenade in a grenade pouch. In this regard, the various embodiments of the present invention substantially fulfill at least some of these needs. In this respect, the grenade pouch lid according to the present invention substantially departs from the conventional concepts and designs of the prior art, and in doing so provides an apparatus primarily developed for the purpose of protecting a grenade primer from impact and securing the grenade in a grenade pouch.

SUMMARY OF THE INVENTION

The present invention provides an improved grenade pouch lid, and overcomes the above-mentioned disadvantages and drawbacks of the prior art. As such, the general purpose of the present invention, which will be described subsequently in greater detail, is to provide an improved grenade pouch lid that has all the advantages of the prior art mentioned above.

To attain this, the preferred embodiment of the present invention essentially comprises a planar body having an arcuate periphery, the arcuate periphery including a rim engagement feature, and the rim engagement feature is operable to secure the planar body to an object having a disc-shaped rim when the rim engagement feature is urged against the rim. The rim engagement feature may include at least two spaced apart elements defining a space therebetween for receiving the rim. The planar body may include a slot, the slot being operable to receive one end of a strap. The planar body may include a wedge shaped portion, the wedge-shaped portion being opposed to the rim engagement feature. The rim engagement feature and the rim may have the same radius. The planar body may cover the center of the rim when the planar body is secured to the object. The object having a disc-shaped rim may be a 40 mm grenade. A grenade pouch is also disclosed. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
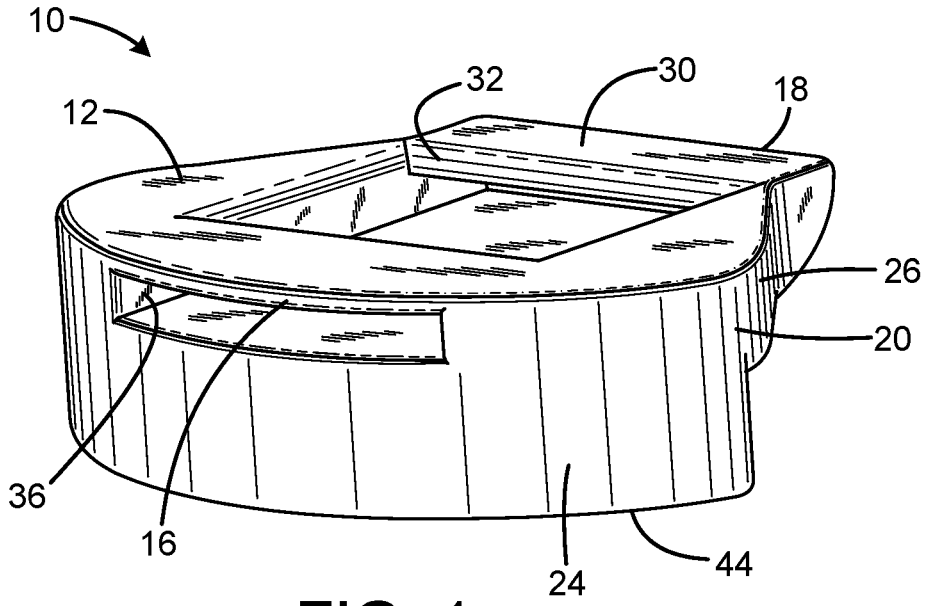
FIG. 1 is a top front isometric view of the current embodiment of the grenade pouch lid constructed in accordance with the principles of the present invention.
Figure 2:
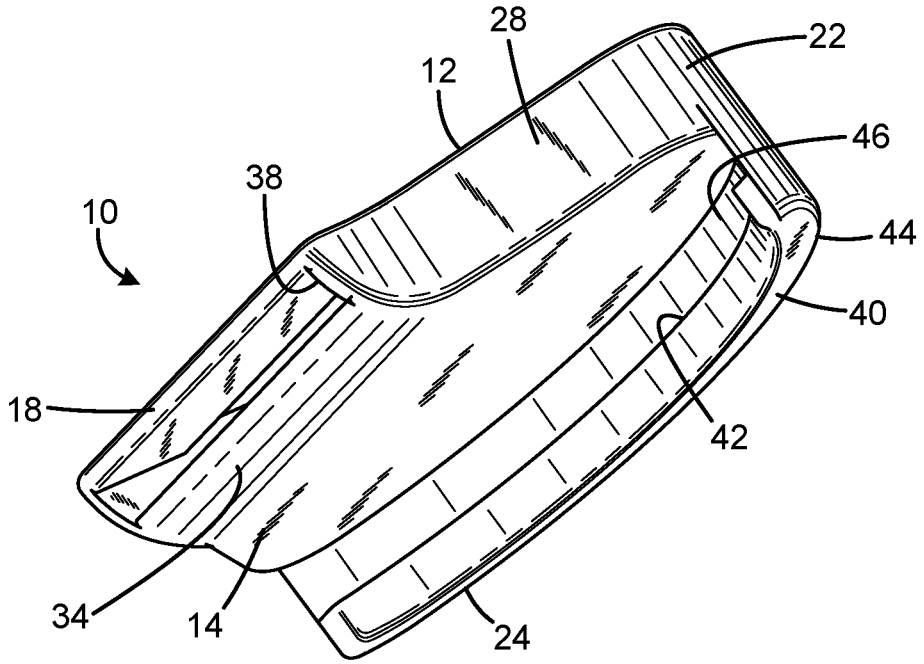
FIG. 2 is a bottom rear isometric view of the current embodiment of the grenade pouch lid of FIG. 1.
Figure 3:
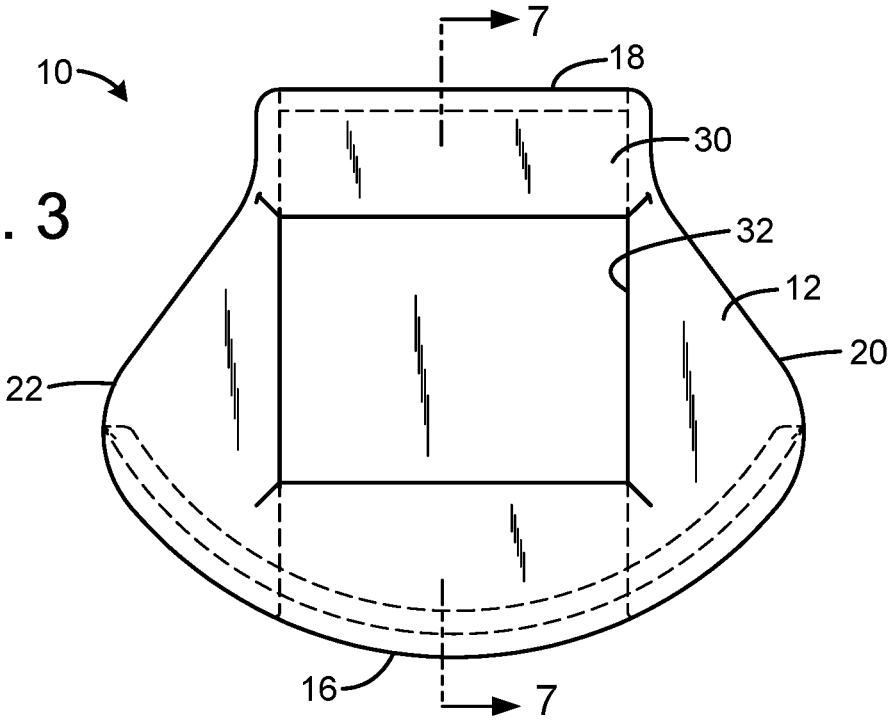
FIG. 3 is a top view of the current embodiment of the grenade pouch lid of FIG. 1.
Figure 4:
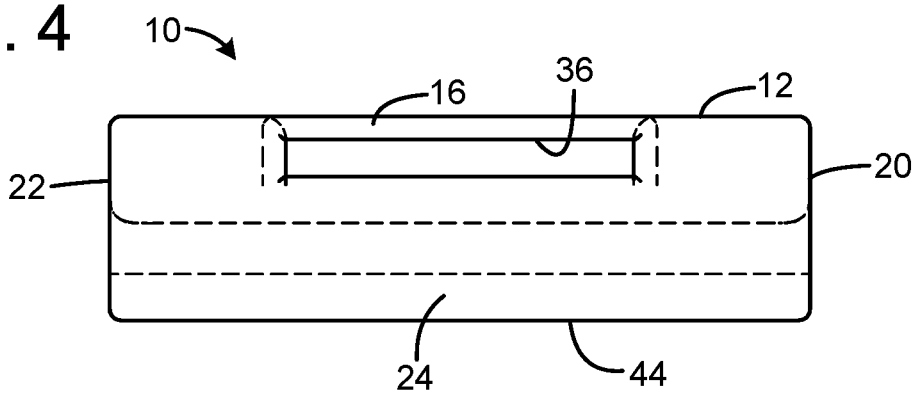
FIG. 4 is a rear view of the current embodiment of the grenade pouch lid of FIG. 1.
Figure 5:
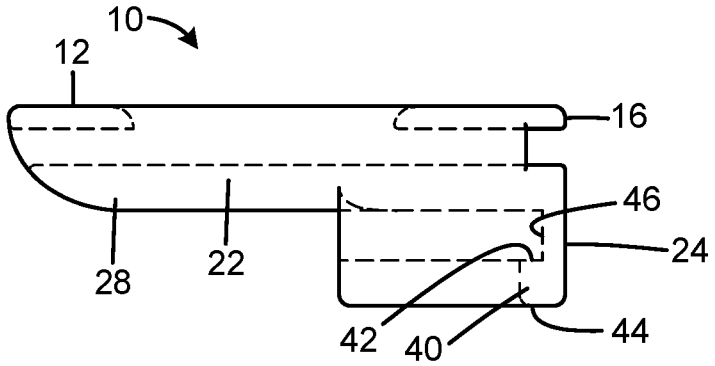
FIG. 5 is a right side view of the current embodiment of the grenade pouch lid of FIG. 1.
Figure 6:
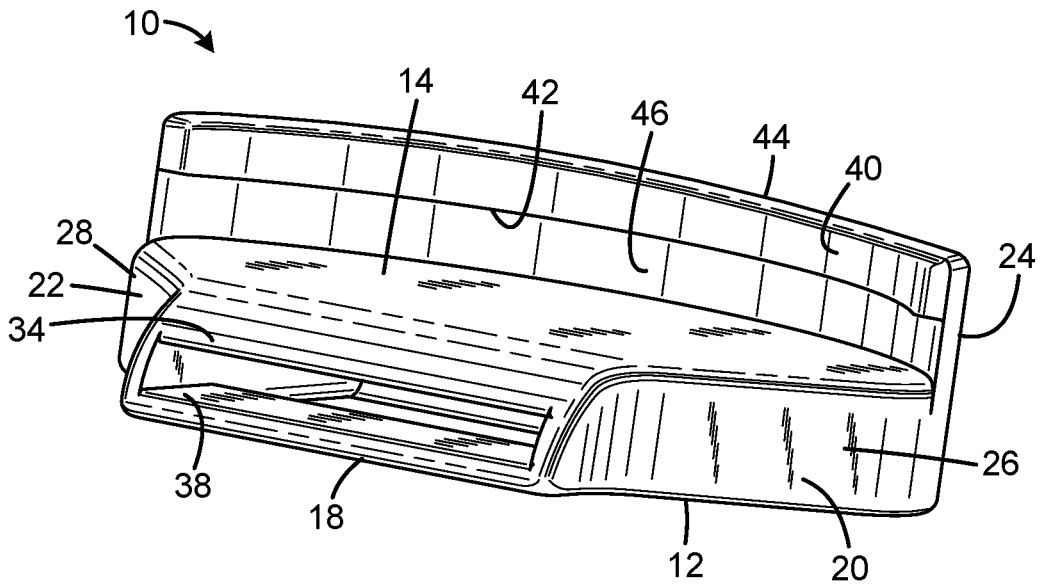
FIG. 6 is a bottom rear isometric view of the current embodiment of the grenade pouch lid of FIG. 1.
Figure 7:
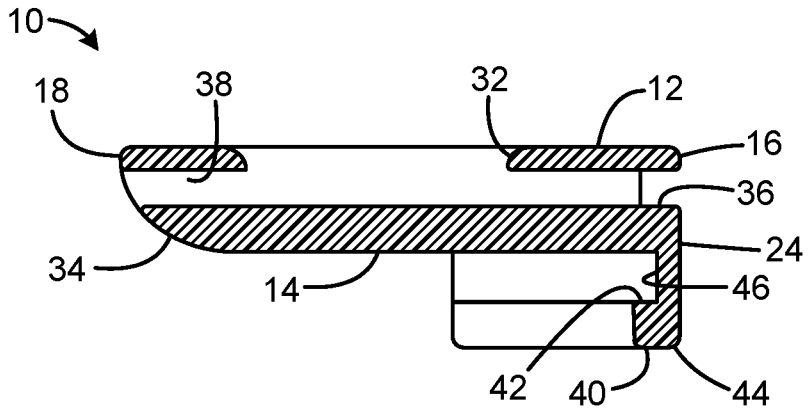
FIG. 7 is a sectional view of the current embodiment of the grenade pouch lid taken along the line 7-7 of FIG. 1.

An embodiment of the grenade pouch lid of the present invention is shown and generally designated by the reference numeral 10.

FIGS. 1-7 illustrate the improved grenade pouch lid 10 of the present invention. More particularly, the grenade pouch lid is a unitary planar body having a top 12, a bottom 14, a front 16, a rear 18, a left side 20, and a right side 22. The front of the grenade pouch lid is arcuate and measures at least 60°, which is the minimum limit required for stability, and is not exceed 170°, which still allows release, and preferably measuring 120°. The maximum width of the grenade pouch lid is 1.51 inches. The left and right sides taper inwards at an angle of about 45° relative to the rear of the grenade pouch lid. The left and right sides become parallel forward of the rear of the grenade pouch lid, which they meet substantially perpendicularly to form a generally rectangular portion 30. The top of the grenade pouch lid defines a substantially rectangular opening 32 between the rectangular portion, the left and right sides, and the front. However, the rectangular opening does not extend completely through the top of the grenade pouch lid, so the bottom of the grenade pouch lid is a planar plate that is solid throughout. The bottom of the grenade pouch lid beneath the rectangular portion 30 tapers upwards at the rear to form a wedge surface 34.

A front skirt 24 extends perpendicularly downwards from the top front of the grenade pouch lid, and a left skirt 26 and a right skirt 28 extend perpendicularly downwards from the left and right sides, respectively, of the grenade pouch lid. The front skirt extends downwards further than do the left and right skirts (about 2 ½ times in the current embodiment). The skirts match the contours of the top of the grenade pouch lid. The rear of the left and right skirts tapers upwards to match the contour of the wedge surface 34.

The front skirt 24 defines a generally rectangular slot 36 immediately below the top 12 of the grenade pouch lid 10. The wedge surface 34 in the rear of the grenade pouch lid defines a generally rectangular slot 38 immediately below the top 12 of the grenade pouch lid. The front and rear slots are axially registered and are both in communication with the rectangular opening 32 in the top of the grenade pouch lid.

The front skirt 24 has a rearward-facing interior surface 46. The bottom 44 of the front skirt 24 has an attached flange 40. The flange matches the contour of the bottom of the front skirt and extends rearward. A slot 42 is defined between the bottom 14 of the top 12 of the grenade pouch lid 10 and the flange 40.

Although the grenade pouch lid 10 of the current invention has been described as being composed of a plurality of discrete elements, a preferred embodiment of the grenade pouch lid is a unitary construction made of molded plastic.

Figure 8:
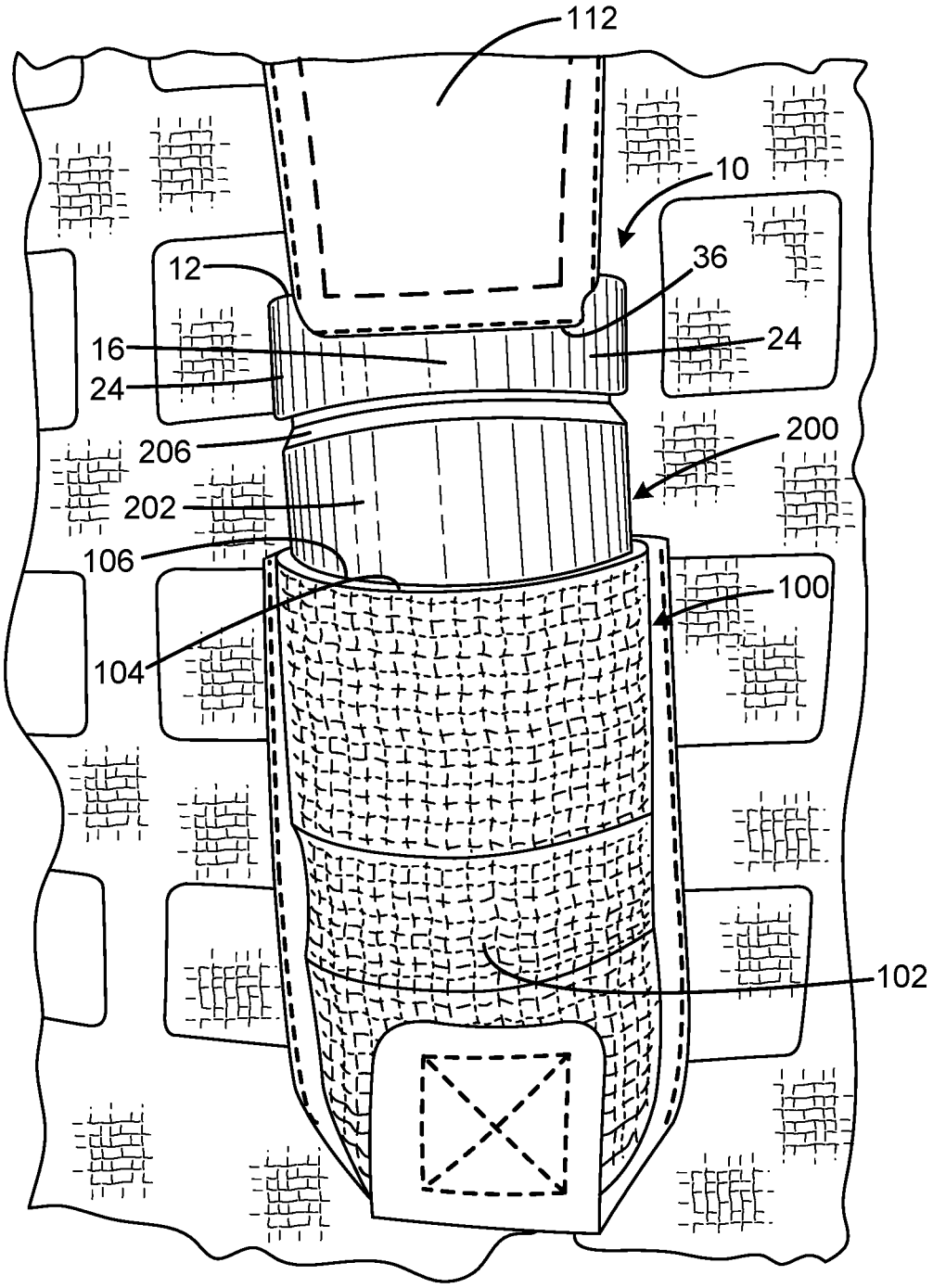
FIG. 8 is a front view of the current embodiment of the grenade pouch lid of FIG. 1 installed on a grenade pouch and securing a 40 mm grenade therein.
Figure 9:
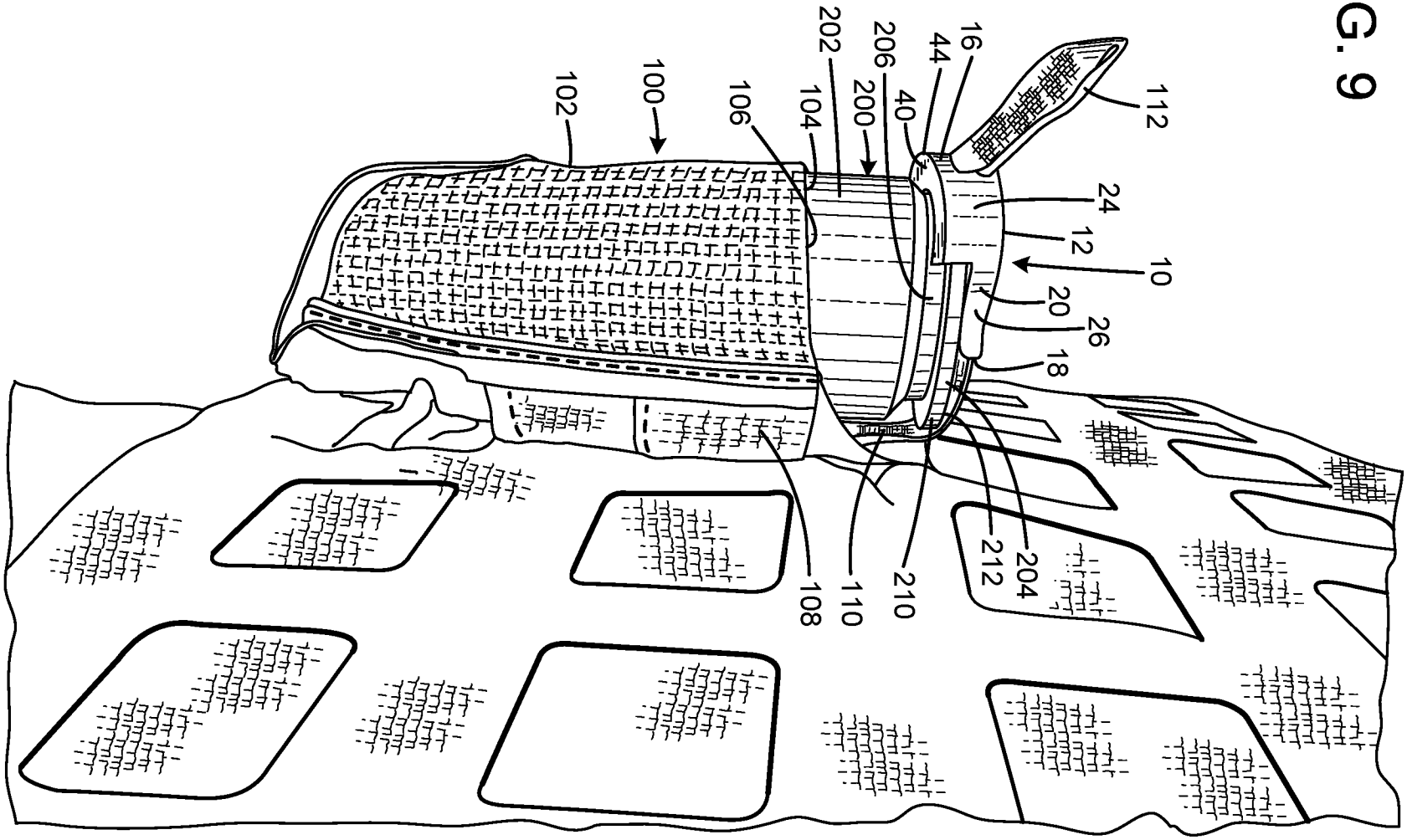
FIG. 9 is a left side view of FIG. 8.

FIGS. 8 and 9 illustrate the improved grenade pouch lid 10 of the present invention installed on a grenade pouch 100. More particularly, the grenade pouch lid is shown securing a 40 mm grenade 200 within the grenade pouch. The top 104 of the grenade pouch defines an aperture 106 that extends from the front 102 to the rear 108. The cylindrical case 202 of the grenade is inserted into the grenade pouch such that the base 212 protrudes upwards above the top of the grenade pouch. The base forms a circular disk-shaped rim 204, and the case defines a circumferential slot 206 immediately below the rim. For a standard 40 mm grenade, the radius of the rim is 0.82 inch and the thickness of the rim is 0.08 inch.

An elastic strap 110 has opposed ends with one end attached to the rear 108 of the grenade pouch 200. The elastic strap extends downward through the aperture 106 into the pouch. The other end of the elastic strap is passed through the rear slot 38, extends across the grenade pouch lid 10 beneath the rectangular opening 32, and exits through the front slot 36. A gripping tab 112 is attached thereto, which prevents the elastic strap from disengaging from the grenade pouch lid and facilitates grasping of the end of the elastic strap by a user. In the current embodiment, the gripping tab is made of fabric.

When the grenade pouch lid 10 secures a grenade 200 within the grenade pouch 100, the rim 204 is received within the slot 42 between the flange 40 and the bottom 14 of the grenade pouch lid. The elastic strap 110 is distended when the grenade pouch lid is engaged with a grenade and urges the grenade pouch lid rearward such that the interior surface 46 of the front skirt 24 closely abuts the outer periphery 210 of the rim. In the current embodiment, the interior surface has the same radius (0.82 inch) as the rim, and the slot 42 has a width of 0.11 inch, which is slightly larger than the thickness of the rim, so the grenade pouch lid can easily engage and disengage from the grenade.

The continuous surface of the bottom 14 of the grenade pouch lid 10 covers the primer 208 (visible in FIGS. 10-13) on the base 212 of the grenade 200. As a result, the force generated by an object impacting the grenade pouch lid, even if centered over the primer, is not transmitted directly to the primer. Instead, the impact force is distributed by the grenade pouch lid over a substantial portion of the rim 204 of the grenade, thereby greatly decreasing the chance of unintentional discharge of the grenade.

Figure 10:
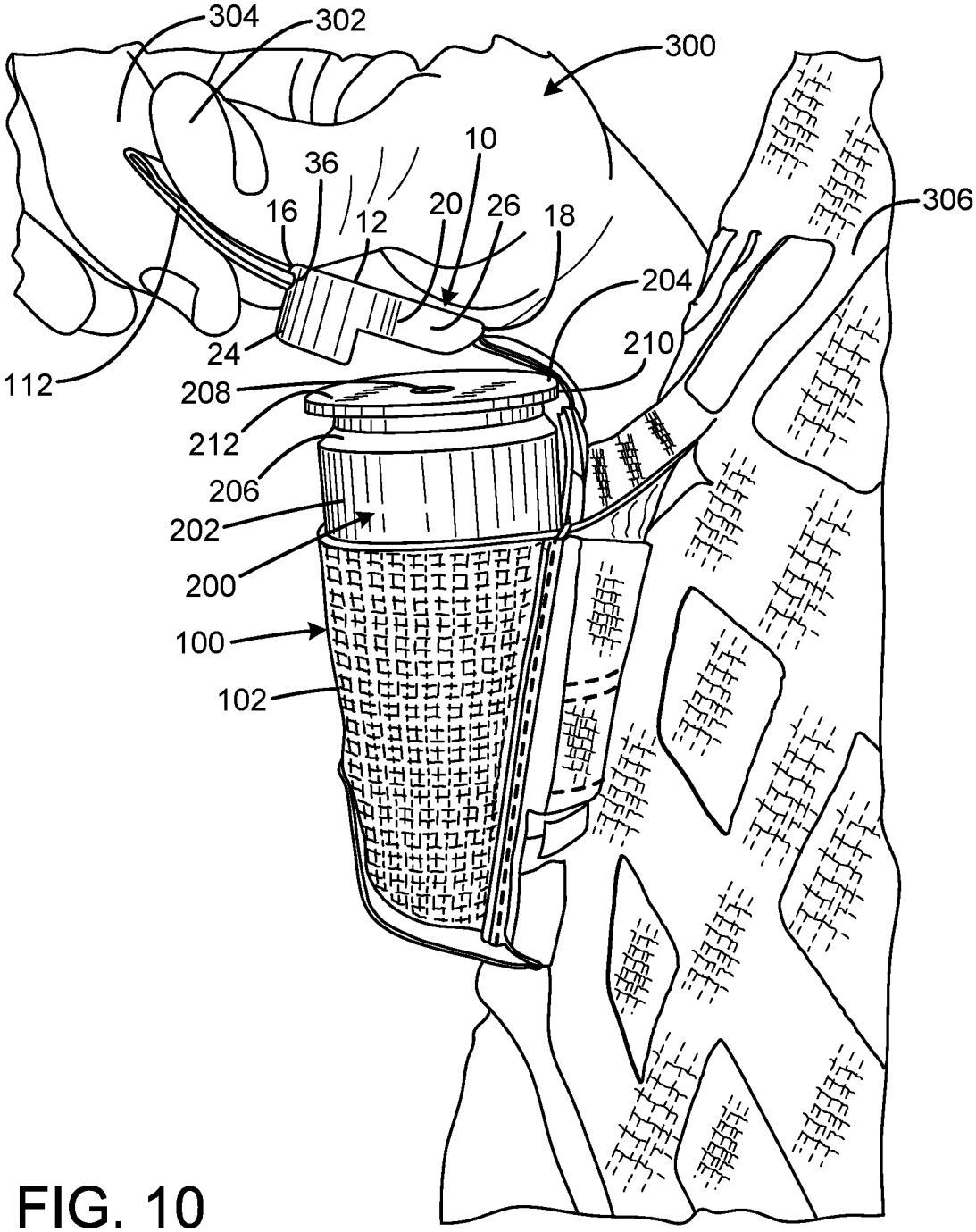
FIG. 10 is a left side view of FIG. 8 during the initiation of the grenade pouch lid disengagement process.
Figure 11:
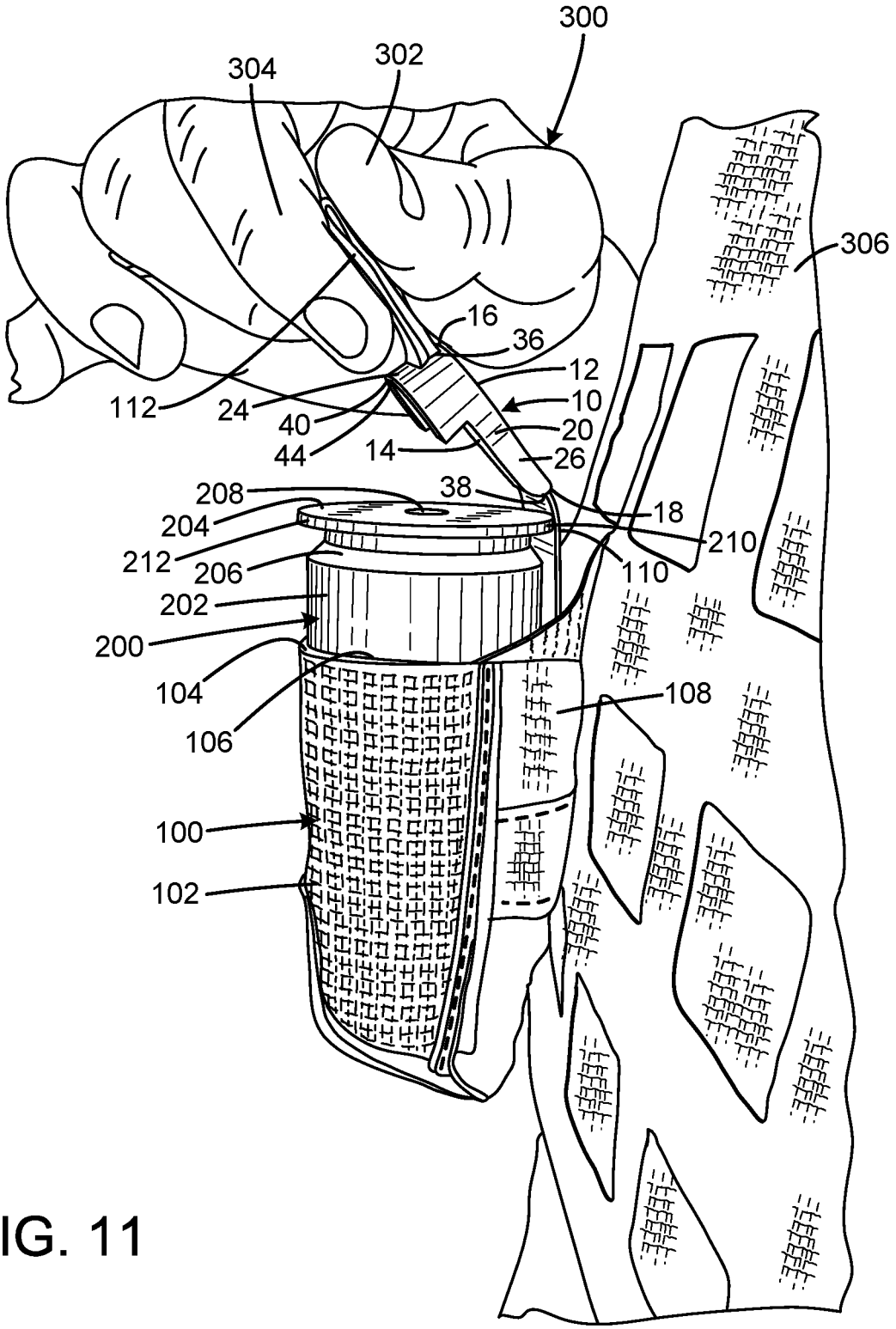
FIG. 11 is a view similar to FIG. 10 showing the next step of the grenade pouch lid disengagement process.

FIGS. 10-13 illustrate the improved grenade pouch lid 10 of the present invention installed on a grenade pouch 100. More particularly, the figures depict the sequence of operations required to disengage the grenade pouch lid from a secured grenade 200 to make the grenade accessible. In FIG. 10, the hand 300 of a user is shown. The user has grasped the gripping tab between the thumb 302 and forefinger 304. The user initially pulls the gripping tab forward parallel to the base 212 of the grenade, which stretches the elastic strap 110, until the rim 204 of the grenade pouch lid has completely disengaged from the slot 42 in the grenade pouch lid. The user then lifts the gripping tab upward until the flange 40 has cleared the outer periphery 210 of the rim. The user then permits the elastic strap to begin to retract and pull the grenade pouch lid rearwards while continuing to lift the gripping tab upwards until the wedge surface 34 is above the outer periphery of the rim. At that point, the user releases the gripping tab.

Figure 12:
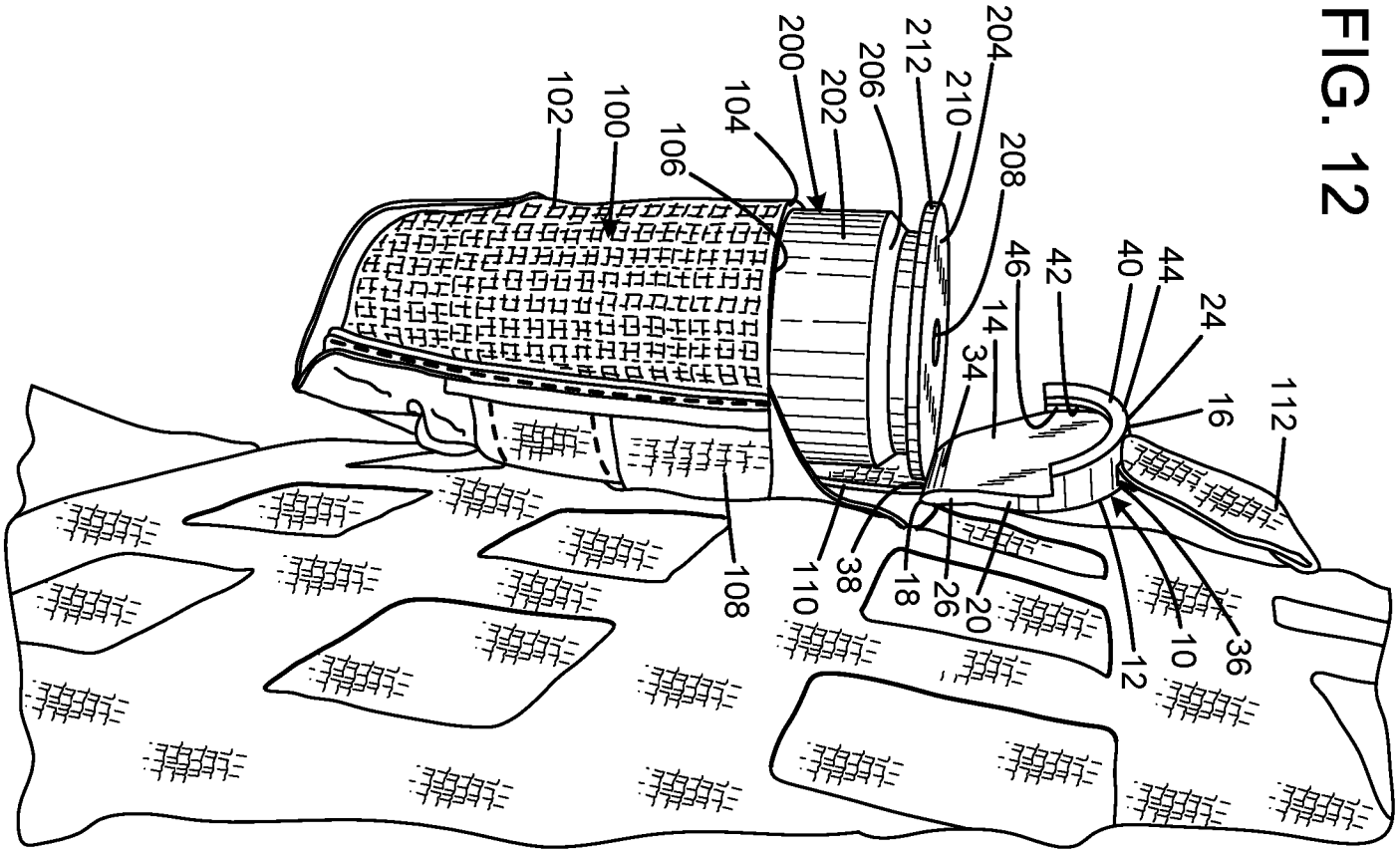
FIG. 12 is a view similar to FIG. 11 showing the next step of the grenade pouch lid disengagement process.
Figure 13:
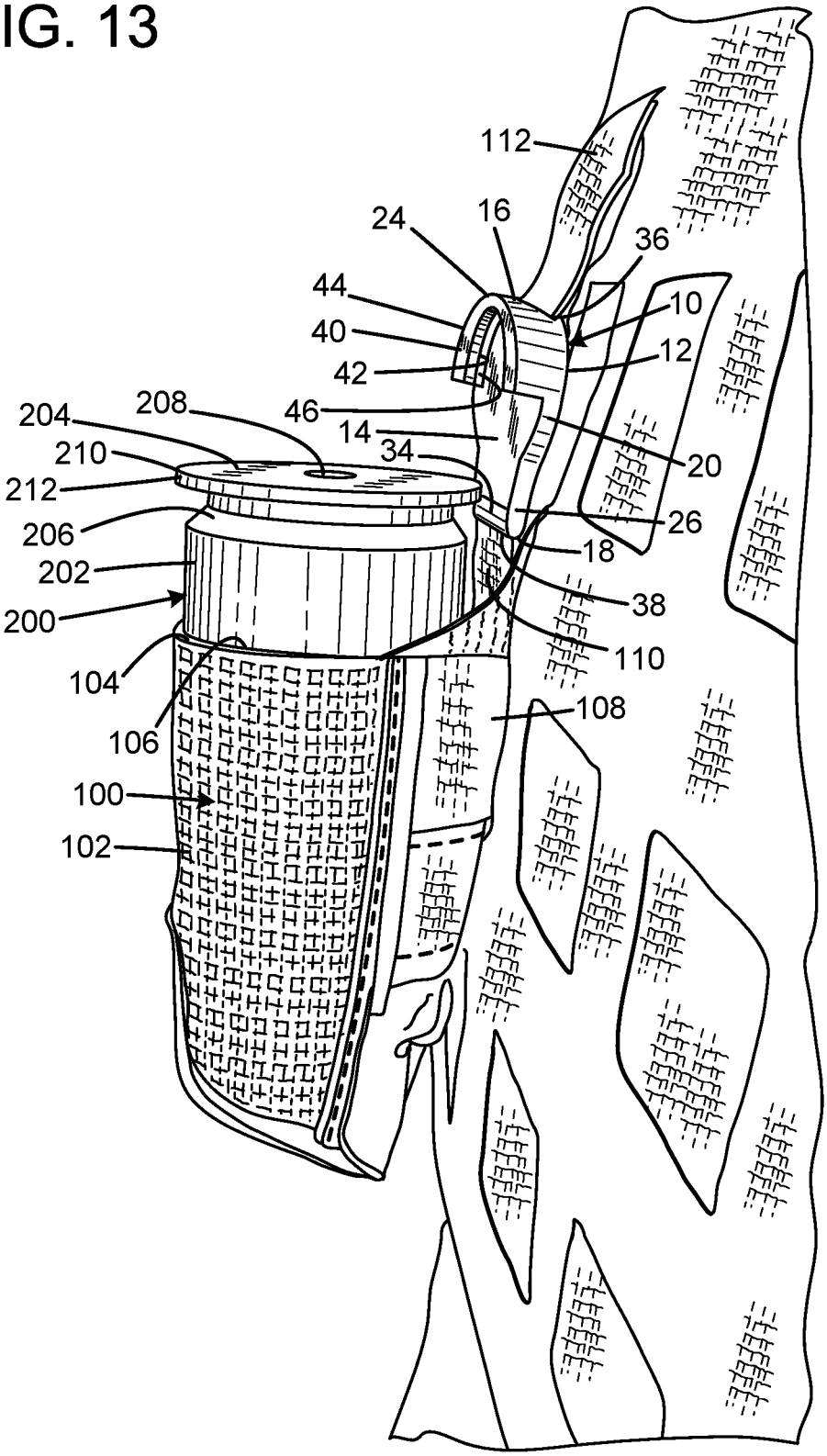
FIG. 13 is a view similar to FIG. 12 showing the final step of the grenade pouch lid disengagement process.

As is shown in FIGS. 12 and 13, the continued retraction of the elastic strap 110 brings the wedge surface 34 into contact with the outer periphery 210 of the rim 204. The wedge surface initially pivots the grenade pouch lid 10 upwards substantially parallel to the rear 108 of the grenade pouch 100. The wedge surface then enables the rear 18 of the grenade pouch lid to slide downwards between the outer periphery of the rim of the grenade 200 and the body 306 of the user until the elastic strap has fully retracted. In this position, the rim and slot 206 are readily accessible to facilitate removal of the grenade from the grenade pouch, and the grenade pouch lid is held flat against the user's body so that the grenade pouch lid is not flopping about and clicking on the grenade case 202 when the user is in motion.

Figure 14:
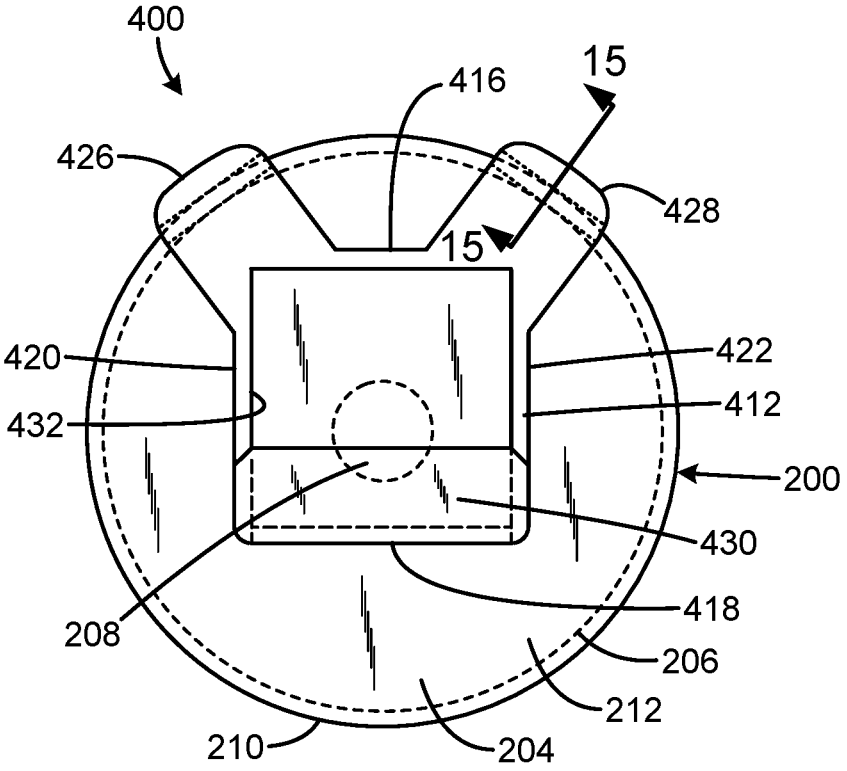
FIG. 14 is a top view of a first alternative embodiment of the grenade pouch lid constructed in accordance with the principles of the present invention and installed on a 40 mm grenade.
Figure 15:
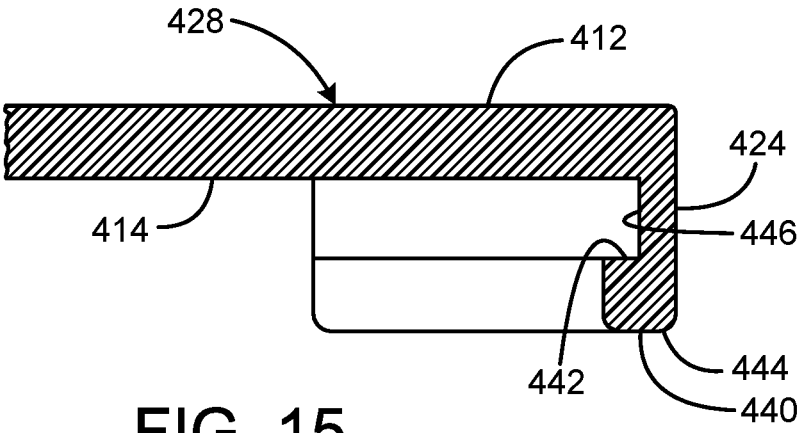
FIG. 15 is a sectional view of the first alternative embodiment of the grenade pouch lid taken along the line 15-15 of FIG. 14.

FIGS. 14-15 illustrate the improved grenade pouch lid 400 of the present invention. More particularly, the grenade pouch lid is a unitary planar body having a top 412, a bottom 414, a front 416, a rear 418, a left side 420, and a right side 422. The left and right sides are parallel and meet the rear substantially perpendicularly to form a generally rectangular portion 430. The top of the grenade pouch lid defines a substantially rectangular opening 432 between the rectangular portion, the left and right sides, and the front. However, the rectangular opening does not extend completely through the top of the grenade pouch lid, so the bottom of the grenade pouch lid is a planar plate that is solid throughout. The bottom of the grenade pouch lid beneath the rectangular portion 430 tapers upwards at the rear to form a wedge surface. The front defines a generally rectangular slot immediately below the top of the grenade pouch lid. The wedge surface in the rear of the grenade pouch lid defines a generally rectangular slot immediately below the top of the grenade pouch lid. The front and rear slots are axially registered and are both in communication with the rectangular opening in the top of the grenade pouch lid.

The front of the grenade pouch lid has two forwardly extending arms 426, 428. Each of the arms is offset by 60° relative to the front and define a 60° angle between them. Each has a non-arcuate front skirt (424 is shown). The front skirts each have a rearward-facing interior surface (446 is shown). The bottom (444 is shown) of the front skirts has an attached flange (440 is shown). The flanges match the bottom of the front skirts and extend rearward. A slot (442 is shown) is defined between the bottom 414 of the top 12 of the grenade pouch lid 400 and the flanges.

Although the grenade pouch lid 400 of the current invention has been described as being composed of a plurality of discrete elements, a preferred embodiment of the grenade pouch lid is a unitary construction made of molded plastic.

When the grenade pouch lid 400 secures a grenade 200 within a grenade pouch 100 utilizing an elastic strap 110 that is passed through the rear slot, extends across the grenade pouch lid beneath the rectangular opening 432, and exits through the front slot, the rim 204 is received within the slots between the flanges and the bottom 414 of the grenade pouch lid. The interior surfaces of the front skirts tangentially abut the outer periphery 210 of the rim. In the current embodiment, the slots have a width of 0.11 inch, which is slightly larger than the thickness of the rim, so the grenade pouch lid can easily engage and disengage from the grenade.

The continuous surface of the bottom 414 of the grenade pouch lid 400 covers the primer 208 on the base 212 of the grenade 200. As a result, the force generated by an object impacting the grenade pouch lid, even if centered over the primer, is not transmitted directly to the primer. Instead, the impact force is distributed by the grenade pouch lid over a substantial portion of the rim 204 of the grenade, thereby greatly decreasing the chance of unintentional discharge of the grenade.

Figure 16:
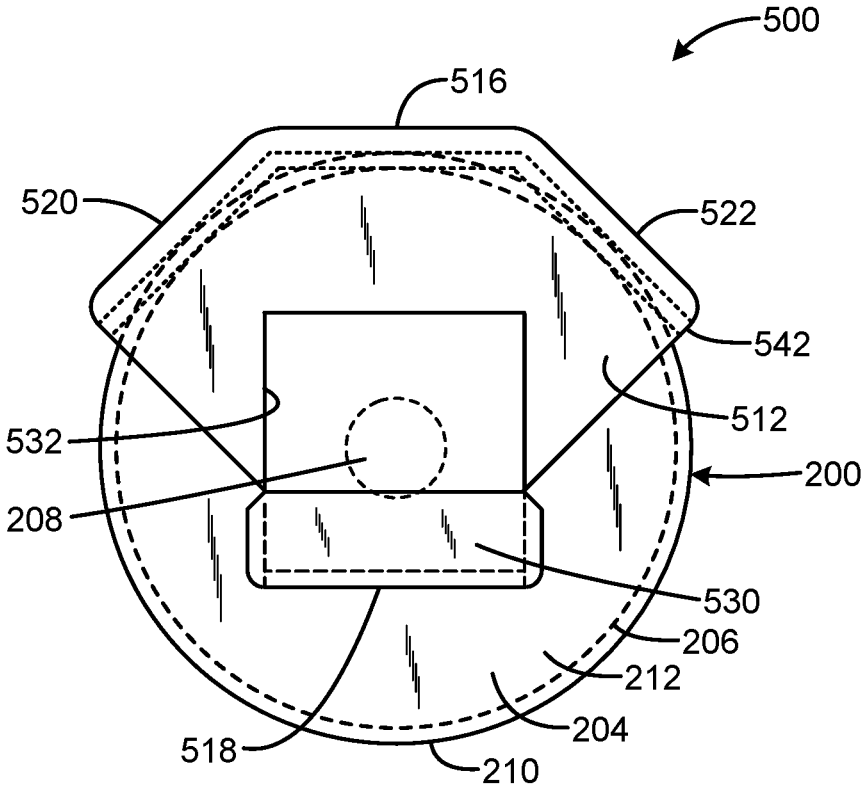
FIG. 16 is a top view of a second alternative embodiment of the grenade pouch lid constructed in accordance with the principles of the present invention and installed on a 40 mm grenade.

FIG. 16 illustrates the improved grenade pouch lid 500 of the present invention. More particularly, the grenade pouch lid is a unitary planar body having a top 512, a bottom, a front 516, a rear 518, a left side 520, and a right side 522. The left and right sides taper inwards at an angle of about 40° relative to the rear of the grenade pouch lid. The left and right sides become parallel forward of the rear of the grenade pouch lid, which they meet substantially perpendicularly to form a generally rectangular portion 530. The top of the grenade pouch lid defines a substantially rectangular opening 532 between the rectangular portion, the left and right sides, and the front. However, the rectangular opening does not extend completely through the top of the grenade pouch lid, so the bottom of the grenade pouch lid is a planar plate that is solid throughout. The bottom of the grenade pouch lid beneath the rectangular portion 530 tapers upwards at the rear to form a wedge surface. The front defines a generally rectangular slot immediately below the top of the grenade pouch lid. The wedge surface in the rear of the grenade pouch lid defines a generally rectangular slot immediately below the top of the grenade pouch lid. The front and rear slots are axially registered and are both in communication with the rectangular opening in the top of the grenade pouch lid.

The front of the grenade pouch lid forms three sides of an octagon in the current embodiment. Each has a non-arcuate front skirt extending downwardly. The front skirts each have a rearward-facing interior surface. The bottom of the front skirts has an attached flange. The flanges extend rearward. A slot (542 is shown) is defined between the bottom of the top 12 of the grenade pouch lid 500 and the flanges.

Although the grenade pouch lid 500 of the current invention has been described as being composed of a plurality of discrete elements, a preferred embodiment of the grenade pouch lid is a unitary construction made of molded plastic.

When the grenade pouch lid 500 secures a grenade 200 within a grenade pouch 100 utilizing an elastic strap 110 that is passed through the rear slot, extends across the grenade pouch lid beneath the rectangular opening 532, and exits through the front slot, the rim 204 is received within the slots between the flanges and the bottom 414 of the grenade pouch lid. The interior surface of the front skirts tangentially abuts the outer periphery 210 of the rim. In the current embodiment, the slots have a width of 0.11 inch, which is slightly larger than the thickness of the rim, so the grenade pouch lid can easily engage and disengage from the grenade.

The continuous surface of the bottom of the grenade pouch lid 500 covers the primer 208 on the base 212 of the grenade 200. As a result, the force generated by an object impacting the grenade pouch lid, even if centered over the primer, is not transmitted directly to the primer. Instead, the impact force is distributed by the grenade pouch lid over a substantial portion of the rim 204 of the grenade, thereby greatly decreasing the chance of unintentional discharge of the grenade.

Figure 17:
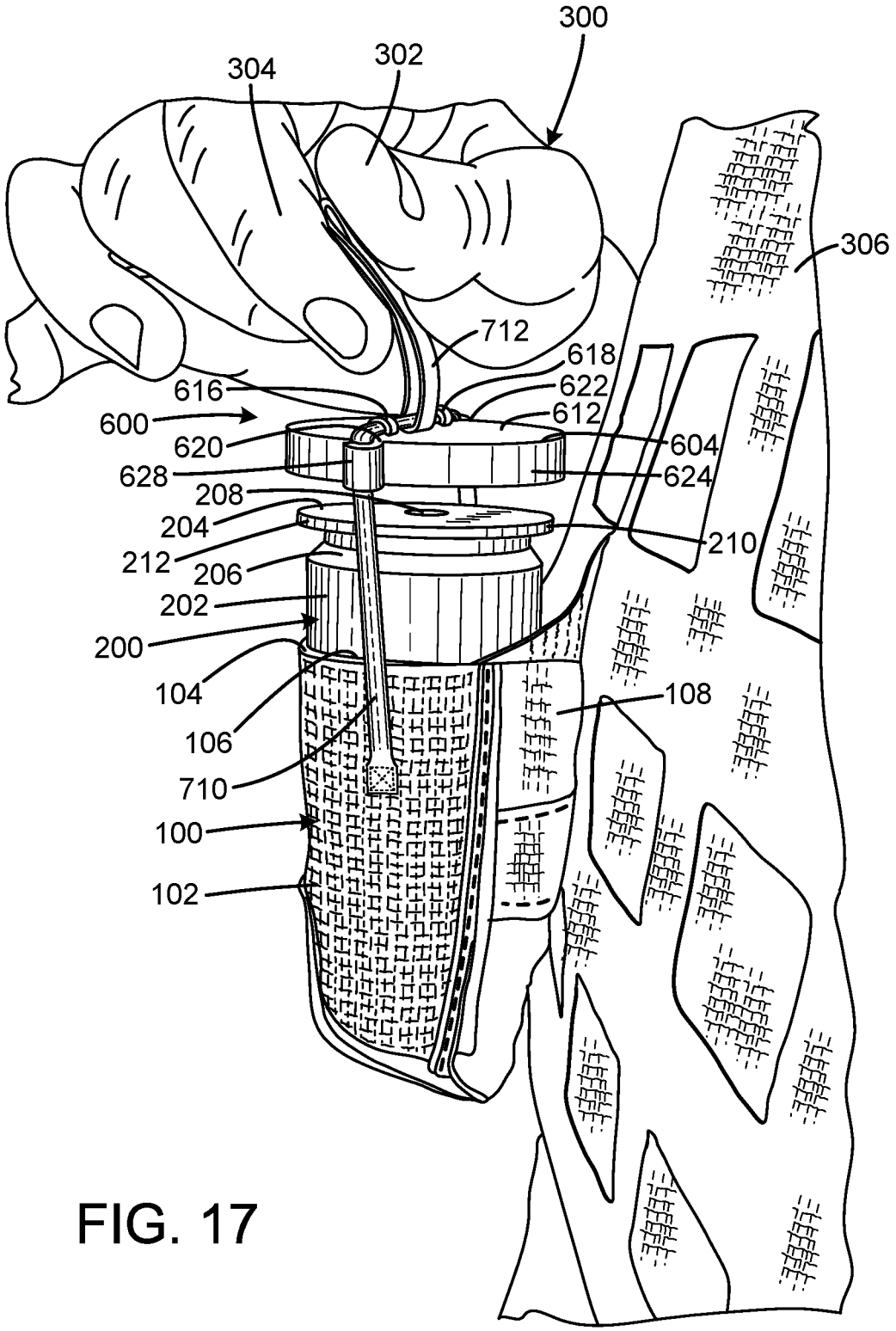
FIG. 17 is a left side view of a third alternative embodiment of the grenade pouch lid constructed in accordance with the principles of the present invention during the initiation of the grenade pouch lid disengagement process.
Figure 18:
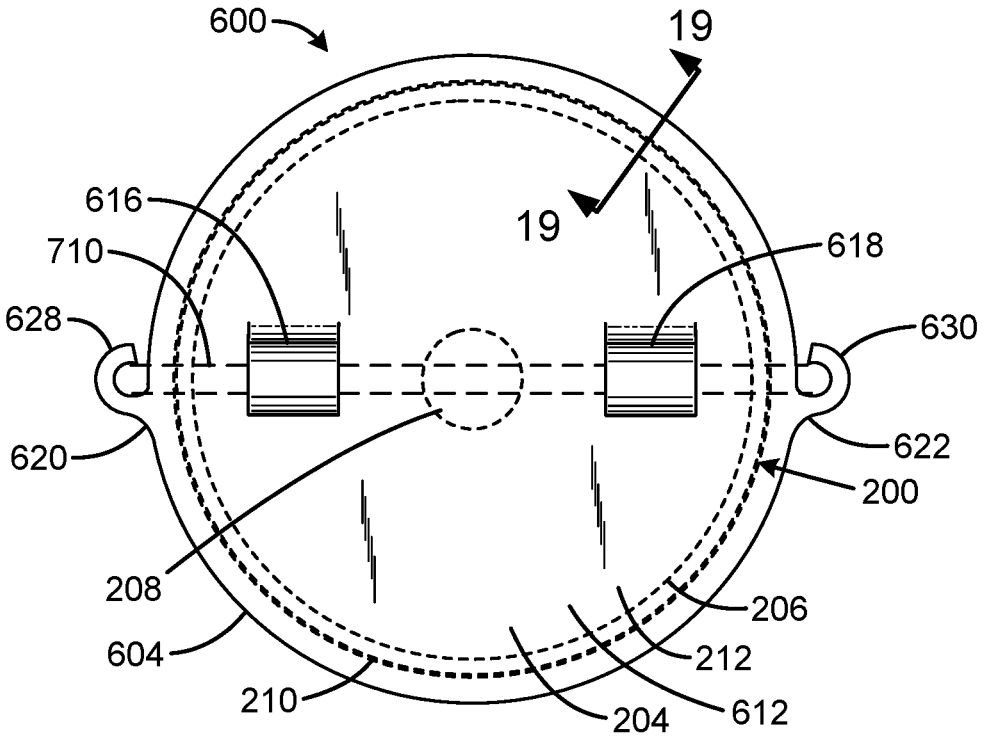
FIG. 18 is a top view of the third alternative embodiment of the grenade pouch lid of FIG. 17 installed on a 40 mm grenade.
Figure 19:
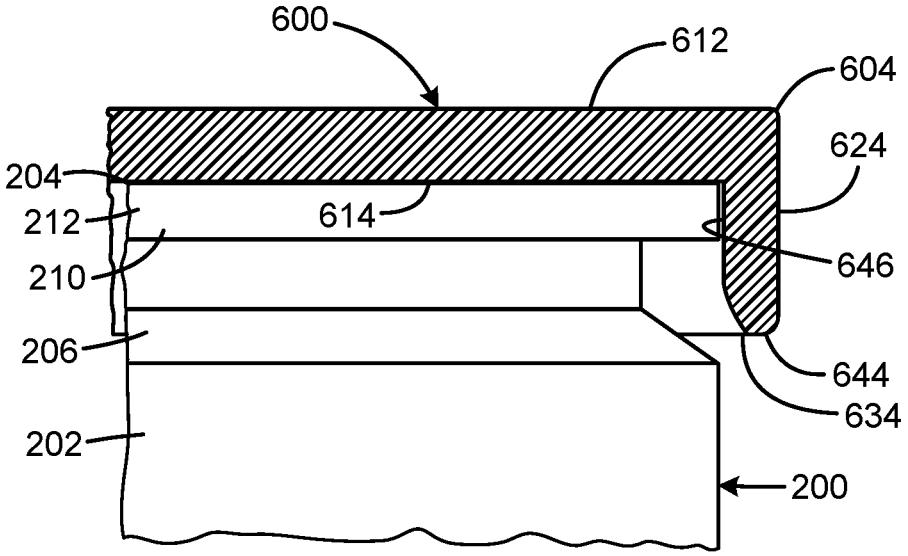
FIG. 19 is a side sectional fragmentary view taken along line 19-19 of FIG. 18.

FIGS. 17-19 illustrate the improved grenade pouch lid 600 of the present invention. More particularly, the grenade pouch lid is a unitary planar body having a top 612, a bottom 614, a rim 604, a left side 620, and a right side 622. The rim is circular in the current embodiment with a downwardly-extending skirt 624. The left side of the skirt includes an outwardly-extending left side clip 628, and the right side of the skirt includes an outwardly-extending right side clip 630. The top of the grenade pouch lid includes upwardly extending left top clip 616 and right top clip 618. Each of the clips has a semi-circular interior that is shaped to removably retain an elastic strap 710. The elastic strap passes through the right side clip 630, extends across the top 612 of the grenade pouch lid beneath the right top clip 618 and left top clip 616, and passes through the left side clip 628. The opposing ends of the elastic strap are attached to a pouch 100 to connect the grenade pouch lid to the pouch. In the current embodiment, the opposing ends of the elastic band are sewn onto the exterior of the pouch. A gripping tab 712 is attached to the elastic strap, which facilitates grasping of the middle of the elastic strap by a user. In the current embodiment, the gripping tab is made of fabric.

The grenade pouch lid is a planar plate that is solid throughout. The bottom 644 of the skirt 624 tapers upwards to form a wedge surface 634 below the interior surface 646 of the skirt. The wide surface increases the diameter of the bottom of the skirt to facilitate insertion of the base 210 of a grenade 200. The interior surface of the skirt is sized to closely receive the base of the grenade.

Although the grenade pouch lid 600 of the current invention has been described as being composed of a plurality of discrete elements, a preferred embodiment of the grenade pouch lid is a unitary construction made of molded plastic.

When the grenade pouch lid 600 secures a grenade 200 within a grenade pouch 100, the elastic strap 710 is distended and urges the grenade pouch lid downwards onto the base 212 of the grenade. The interior surface 646 of the skirt 624 tangentially abuts the outer periphery 210 of the rim 204. In FIG. 17, the hand 300 of a user is shown. The user has grasped the gripping tab 712 between the thumb 302 and forefinger 304. The user initially lifts the gripping tab upward perpendicular to the base 212 of the grenade, which stretches the elastic strap 710, until the bottom 644 of the skirt 624 of the grenade pouch lid is above the outer periphery 210 of the rim. The user then pulls the grenade pouch lid rearwards and pivots the grenade pouch lid upwards substantially parallel to the rear 108 of the grenade pouch 100. Once the grenade pouch lid has cleared the outer periphery 210 of the rim, the user then permits the elastic strap to begin to retract and pull the grenade pouch lid downwards. At that point, the user releases the gripping tab.

The continuous surface of the bottom 614 of the grenade pouch lid 600 covers the primer 208 on the base 212 of the grenade 200. As a result, the force generated by an object impacting the grenade pouch lid, even if centered over the primer, is not transmitted directly to the primer. Instead, the impact force is distributed by the grenade pouch lid over a substantial portion of the rim 204 of the grenade, thereby greatly decreasing the chance of unintentional discharge of the grenade.

While current embodiments of a grenade pouch lid have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any object having a cylindrical base can be retained by the grenade pouch lid instead of the 40 mm grenade described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A grenade pouch configured to removably contain a grenade having a base defining a circumferential groove, the grenade pouch comprising:

a body defining an elongated receptacle having a closed end and an open end;

a retention element including a lip configured to engage the circumferential groove and connected to the body;

a biasing element biasing the lip in a direction angularly offset from an axis on the body and toward an opposing portion of the body opposite the lip, the biasing element configured to bias the retention element towards a retracted position; and wherein the biasing element has a substantially rectangular face.

* * * * *